US006021038A

United States Patent [19]

Hanchett, Jr.

[11] Patent Number: 6,021,038

[45] Date of Patent: Feb. 1, 2000

[54] CONTROL CIRCUIT FOR AN ELECTRIC DOOR STRIKE USING A LATCHING SOLENOID

[75] Inventor: Leland J. Hanchett, Jr., Phoenix, Ariz.

[73] Assignee: Hanchett Entry Systems, Inc., Phoenix, Ariz.

[21] Appl. No.: 09/141,035

[22] Filed: Aug. 27, 1998

[51] Int. Cl.[7] ..... H01H 47/00

[52] U.S. Cl. ..... 361/156; 361/155; 361/160

[58] Field of Search ..... 70/280–282, 277; 361/154–156, 160, 194, 206, 210

[56] References Cited

U.S. PATENT DOCUMENTS

| | | | |
|---|---|---|---|
| 4,257,081 | 3/1981 | Sauer et al. | 361/156 |
| 5,347,421 | 9/1994 | Alexanian | 361/156 |
| 5,654,865 | 8/1997 | Ryan | 361/154 |
| 5,876,073 | 3/1999 | Geringer et al. | 292/144 |
| 5,933,067 | 8/1999 | Frolov | 335/251 |

FOREIGN PATENT DOCUMENTS

| | | | |
|---|---|---|---|
| 2805342A1 | 8/1979 | Germany | 361/156 |

*Primary Examiner*—Fritz Fleming
*Attorney, Agent, or Firm*—Warren F. B. Lindsley; Frank J. McGue

[57] ABSTRACT

A control circuit for a latching solenoid incorporated in an electric door strike, the latching solenoid permitting the use of low power control pulses and the control circuit insuring reliable fail safe or fail secure operation with ready conversion between the two operating modes.

10 Claims, 1 Drawing Sheet

FIG. 1A. - FAIL SECURE
(UNLOCKING OPERATION)

SOLENOID CURRENT
FAIL SECURE

FIG. 1B. - FAIL SECURE
(LOCKING OPERATION)

SOLENOID CURRENT
FAIL SAFE

FIG. 2A. - FAIL SAFE
(UNLOCKING OPERATION)

FIG. 2B. - FAIL SAFE
(LOCKING OPERATION)

CONTROL CIRCUIT FOR AN ELECTRIC DOOR STRIKE USING A LATCHING SOLENOID

BACKGROUND OF THE INVENTION

Electric door strikes are commonly used in various places of business where it is desired to control entry into a secured area by means of a remote switch. As an example, the lobby of a building might be separated from the rest of the facility by a door that is secured by an electric door strike. When an individual or group of individuals has been cleared for entry into the main part of the building, the receptionist or security guard releases the strike by means of the switch.

There are two general versions or operating modes of the electric door strike, commonly referenced as "Fail Secure" and "Fail Safe".

In the Fail Secure mode, a loss of power leaves the door strike in the locked condition while in the Fail Safe mode, a loss of power leaves the door strike in the unlocked condition.

A very desirable feature of an electric door strike from the installer's point of view is a simple and inexpensive means for converting a given strike from Fail Secure to Fail Safe or vice versa. It is also desirable to be able to accommodate a wide range of supply voltages so that a given door strike can be controlled by either 12 or 24 volts, for example.

For both operating modes it is also highly desirable to minimize power dissipation in the electric door strike. Low dissipation is important because the strike must operate in a very limited and confined space under less than ideal cooling conditions. To accommodate this requirement, the present invention is directed toward the use of a latching solenoid as an element of an electric door strike. The latching solenoid is set to an extended plunger condition or state by a current pulse of a first polarity and it is set to a withdrawn plunger condition or state by a current pulse of the opposite polarity. The set plunger condition is sustained between current pulses without the benefit of a holding current. Such low duty cycle pulsed operation translates into low power dissipation.

Magnetic latching solenoids are available in several varieties, the most common type being the push solenoid which latches magnetically in the plunger extended condition. When released from this condition by a pulse of the appropriate polarity, the plunger is driven to the withdrawn condition by a spring. The extended condition is thus sustained magnetically and the withdrawn condition is sustained by the spring, both without the benefit of holding current between current pulses.

Another class of latching solenoid is a pull type wherein the magnetically latched position is with the plunger retracted and a spring forces the plunger to the extended state. Of course, configurations of the solenoid also are available where the spring is replaced by yet another permanent magnet and both plunger conditions are sustained magnetically.

Recently, a pull type solenoid was introduced which has a permanent magnet so located as to hold the plunger in the extended position. This version is particularly useful in powering electric strikes because it allows the full force of the pulsed solenoid to withdraw the plunger while at the same time using a very strong permanent magnet to ensure that any vibration or intentional pounding on the end of the solenoid does not start the plunger into false withdrawal motion. This solenoid is also available as a double latching solenoid, i. e. with magnetic latches for both positions.

The present invention comprises a simple control circuit for a latching solenoid. The control circuit of the invention together with the latching solenoid are intended to be incorporated in an electric door strike exhibiting lower power dissipation and reliable fail safe or fail secure operation.

DESCRIPTION OF THE PRIOR ART

Electric door strikes incorporating standard spring biased solenoids and associated control circuits are well known in the prior art but none are known to guarantee by means of a latching solenoid and a very simple control circuit that the solenoid plunger will be set to the desired Fail Safe or Fail Secure condition when power fails.

SUMMARY OF THE INVENTION

In accordance with the invention claimed, a very simple and inexpensive control circuit is provided for reliably controlling a latching solenoid of an electric door strike while guaranteeing that the strike will consistently be set to the desired Fail Safe or Fail Secure condition in the event of a power failure.

It is, therefore, one object of the present invention to provide an improved control circuit for a latching solenoid incorporated in an electric door strike.

Another object of this invention is to provide such a control circuit in a form that is readily adaptable for either Fail Safe or Fail Secure operation.

A further object of this invention is to provide such a control circuit which, when incorporated in an electric door strike together with a latching solenoid will produce an electric door strike that is characterized by low power dissipation, low cost and reliable Fail Safe or Fail Secure operation over a wide range of supply voltage.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which:

FIG. 1A is a schematic diagram showing a solenoid and the solenoid control circuit of the invention adapted for fail secure operation with switch and relay conditions shown for an unlocking operation;

FIG. 1B is a schematic diagram showing the solenoid and the control circuit adapted for fail secure operation with switch and relay conditions shown for a locking operation;

FIG. 2A is a schematic diagram showing the solenoid and the control circuit of the invention adapted for fail safe operation with switch and relay conditions shown for an unlocking operation;

FIG. 2B is a schematic diagram showing the solenoid and the control circuit adapted for fail safe operation with switch and relay conditions shown for a locking operation.

DESCRIPTION OF THE PREFERRED EMBODIMENT

Figure 1C:
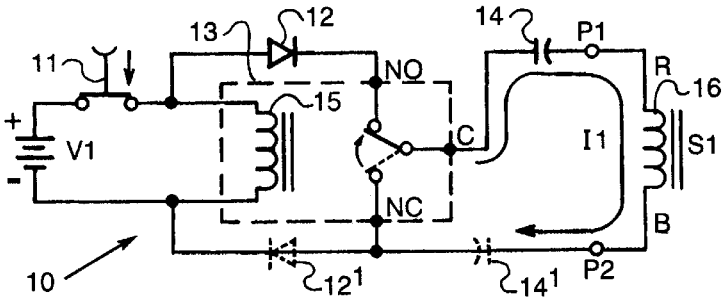
FIG. 1C shows current pulses supplied to the solenoid of FIGS. 1A and 1B during the unlocking and locking operations.
Figure 1C:
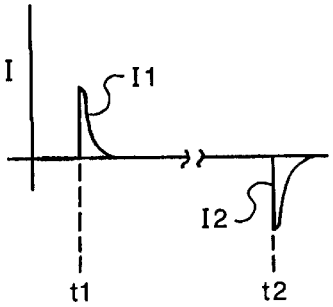

Referring more particularly to the drawing by characters of reference, FIG. 1A discloses a Fail Secure version of the latching solenoid control circuit of the invention. The control circuit 10 comprises a dc voltage source V1, a switch 11, a diode 12, a relay 13, a capacitor 14 and output connector terminals P1 and P2. The control circuit 10 controls a solenoid S1 connected across the output terminals P1 and P2.

The dc voltage source V1 may be a battery or a dc source obtained by rectification of an ac voltage.

Switch 11 is preferably a normally open momentary switch.

Relay 13 is a single pole double throw (SPDT) relay with a coil 15. Its contacts are connected between three load terminals comprising a common terminal C and a normally open terminal NO and a normally closed terminal NC. With no voltage applied to coil 15, continuity is provided between terminal C and terminal NC; with voltage applied to the coil, continuity is provided between terminals C and NO.

The positive terminal of supply V1 is connected through switch 11 to the anode of diode 12 and to a first terminal of relay coil 13. The negative terminal of supply V1 is connected to the normally closed terminal NC of relay 13 and to output terminal P2. The cathode of diode 12 is connected to the normally open terminal NO of relay 13. The common terminal C of relay 13 is connected through capacitor 14 to output terminal P1.

Diode 12 prevents capacitor 14 from discharging energy into voltage source V1 when source V1 collapses. An alternate location for the diode which will give equivalent operation is shown as 12'.

Capacitor 14 needs to be connected in series with solenoid S1. An alternate location for capacitor 14 is shown as 14' in FIG. 1A. Switch 11 may be connected in either the positive or the negative lead of the voltage source.

Solenoid S1 may comprise any one of the various types of latching solenoids. Depending upon the associated door strike mechanism an extended plunger condition may produce a locked condition of the strike, while a retracted plunger unlocks the strike, or vice versa. While either arrangement can be accommodated by the present invention, it is assumed for purposes of explanation that solenoid S1 has a first lead R and a second lead B. It is further assumed that a current pulse I1 entering lead R and leaving at lead B sets solenoid S1 to the condition that unlocks the associated door strike whereas a current entering lead B and exiting at lead R will produce a locked condition of the strike.

The unlocking operation for the Fail Secure circuit of FIG. 1A occurs as follows:

When a visitor has been cleared for entry, the receptionist or security person depresses momentary switch 11, causing switch 11 to close. As switch 11 closes, supply voltage from source V1 is impressed across coil 15 of relay 13. Relay 13 responds by producing continuity between relay terminals No and C whereupon a current pulse I1 flows from the positive terminal of source V1 through switch 11, through diode 12, from terminal No to terminal C of relay 13, through coil 16 of solenoid S1 (entering at P1 and lead R and leaving at lead B and P2) and returning to the negative terminal of supply V1.

In accordance with the assumed definition of solenoid S1 as given earlier, the current pulse I1 causes solenoid S1 to be set and latched to the condition which causes the associated door strike to be released or unlocked. The current pulse I1 terminates when capacitor 14 has charged approximately to the full supply voltage.

By virtue of the latching characteristic of the solenoid S1 the unlocked condition persists as long as the switch 11 remains closed even though the current I1 has decayed to zero.

When the visitor has completed passage through the door, the receptionist or security person releases switch 11', thereby initiating the locking operation as illustrated in FIG. 1B which occurs as follows:

As switch 11 is released it opens, removing voltage from coil 15 of relay 13. Relay 13 responds by breaking contact between terminals NO and C, and making contact between terminals NC and C. As contact is made between terminals NC and C, a discharge path is thereby created for the charge that was placed on capacitor 14 during the unlocking operation of FIG. 1A. Capacitor 14 is now discharged by current pulse I2 which flows from the positively charged terminals of capacitor 14 through the normally closed contact of relay 13 and through coil 16 of latching solenoid S1. It will be noted that in this case the current I2 enters coil 16 at connector pin P2 and coil lead B which is the appropriate direction for locking the associated door strike in accordance with the assumed definition of the solenoid and door strike.

It will also be noted that a loss of supply voltage will in the case of the circuit of FIGS. 1A and 1B have the same effect as the opening of switch 11, i. e. voltage is removed from the coil of relay 13. If the door strike happens to be unlocked at the time of the power loss, a locking operation occurs in the same manner as just described for the intentionally initiated locking operation. Because the circuit of FIGS. 1A and 1B is set to a locked condition when power is lost, it satisfies the conditions for a Fail Secure door strike.

It was one of the objects of this invention to provide easy adaptability for Fail Safe or Fail Secure operation of an associated door strike. In accordance with this objective, the Fail Secure circuit of FIGS. 1A and 1B is readily converted to a Fail Safe circuit by simply reversing the solenoid connections at output connector terminals P1 and P2 and substituting a normally closed momentary switch 11' for the normally open momentary switch 11 of FIGS. 1A and 1B. These changes have been incorporated in the Fail Safe circuits of FIGS. 2A and 2B.

The unlocking operation for the Fail Safe circuit of FIG. 2A occurs as follows:

As normally closed switch 11' opens, supply voltage is removed from coil 15 of relay 13 causing relay 13 to make contact between relay terminals C and NC. The charge developed on capacitor 14 during a previous locking operation (illustrated in FIG. 2B) is now discharged by a current pulse I3 that flows from the positive terminal of capacitor 14 to terminals C and NC of relay 13 and through coil 16 of latching solenoid S1, entering at lead R and leaving at lead B. As indicated earlier, a current pulse flowing in this direction through coil 16 sets a released or unlocked condition for the associated door strike.

When switch 11' is released, it returns to its normally closed condition, thereby initiating the locking operation of FIG. 2B. As switch 11' closes, relay 13 is energized and makes contact between terminals C and NO whereupon a current pulse I4 flows from the positive terminal of source V1 through switch 11', diode 12 relay terminals NO and C, capacitor 14 and solenoid coil 16 to the negative terminal of source V1. In this case the current pulse 14 enters coil 16 at lead B and exits at lead R. As defined earlier, a current pulse flowing in this direction through coil 16 (i. e. entering at lead B) sets the door strike to the desired locked condition.

It will be noted that for the circuit of FIGS. 2A and 2B, a loss of supply voltage is equivalent to the opening of switch 11' as illustrated in FIG. 2A for the unlocking operation. A loss of power is thus seen to produce an unlocked condition consistent with the definition of a Fail Safe door strike.

It has thus been shown that the Fail Secure circuit of FIGS. 1A and 1B is readily converted to the Fail Safe circuit of FIGS. 2A and 2B by reversing the connections of solenoid leads R and B at output connector terminals P1 and P2 and by replacing normally open momentary switch 11 of FIGS. 1A and 1B with the normally closed momentary switch 11' of FIGS. 2A and 2B. To further simplify the conversion process, the momentary switches 11 and 11' can be replaced by one single pole double-action ON/OFF switch which changes state each time it is momentarily depressed. In this case, of course, the receptionist or security person must remember to reset the switch to the locking position following the admission of a visitor.

Figure 2C:
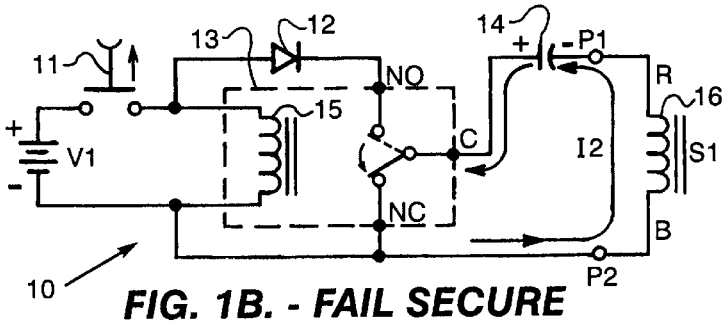
FIG. 2C shows current pulses supplied to the solenoid of FIGS. 2A and 2B during the unlocking and locking operations.
Figure 2C:
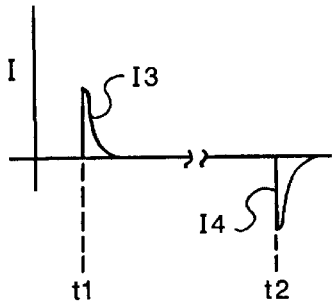

The current wave forms of FIGS. 1C and 2C illustrate the low duty cycle and low dissipation obtained with the latching solenoid door strike. Both figures show solenoid current and both treat a current that enters lead R of the solenoid as a positive current and current that enters lead B as a negative current. As noted earlier, currents I1 and I3 are unlocking currents initiated at time t1 while I2 and I3 are locking currents initiated at time t2. Solenoid currents are seen to be identical for Fail Secure and Fail Safe.

The duration of the current pulses is in the order of milliseconds while the interval between t1 and t2 (release period) is typically several seconds or more, and the time between t2 and a subsequent release command range from seconds to hours. These low-duty-cycle current pulses produce very low power dissipation in the solenoid so a very wide range of source voltage V1 may be accommodated.

In the case of relay coil 15, however, voltage may be applied continuously. For the Fail Safe version of FIGS. 2A and 2B, for example, voltage is applied continuously during the locked or secured condition.

Figure 3:
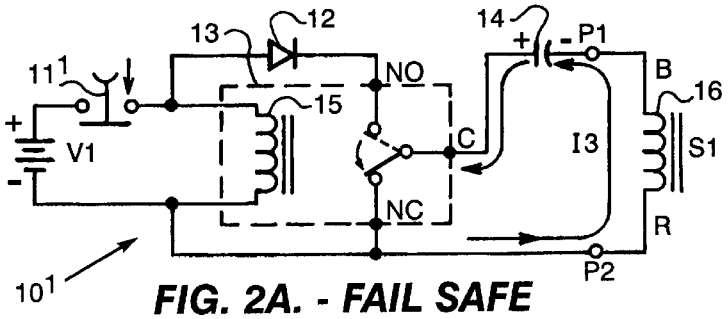
FIG. 3 illustrates the incorporation of a three-terminal regulator as a means for enabling operation over an extended range of supply voltages.
Figure 3:
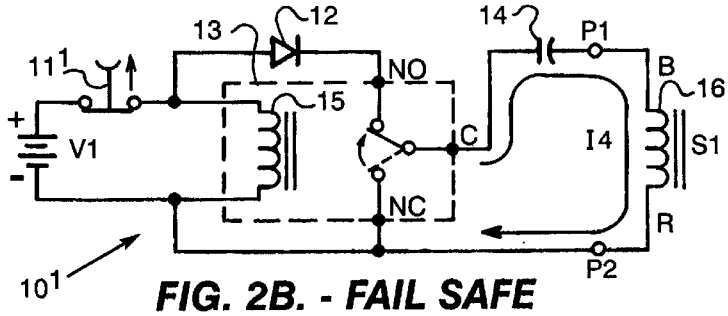
Figure 3:
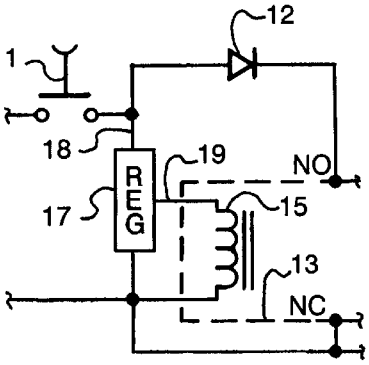

While it is possible to design a relay that can tolerate a wide range of supply voltages, the same capability can be realized through the use of a three-terminal regulator 17 as shown in FIG. 3. Regulator 17 accepts a wide range of voltages at its input terminal 18 and delivers a regulated voltage at its output terminal 19. Using a regulator that is set to deliver a regulated 12 volts at its output for supply voltages exceeding 24 volts, it is thus possible to use a standard 12 volt relay with either 12 volt or 24 volt sources or with any intermediate voltage.

A low power control circuit for an electric door strike is thus provided in a form that is operable over a wide range of supply voltage and readily convertible between Fail Safe and Fail Secure operation in accordance with the stated objects of the invention.

Although but a few embodiments of the invention have been illustrated and described, it will be apparent to those skilled in the art that various changes and modifications may be made therein without departing from the spirit of the invention or from the scope of the appended claims.

What is claimed is:

1. A control circuit for a latching solenoid, said control circuit comprising:

a dc voltage source;

an on/off switch;

a diode;

a capacitor;

connecting means for making connection to the coil of a latching solenoid; and a single pole double throw relay having a coil, a normally closed terminal, a normally open terminal and a common terminal, said relay making contact between said normally closed terminal and said common terminal when said coil of said relay is deenergized and said relay making contact between said normally open and said common terminal when said coil of said relay is energized; whereby:

when said on/off switch is closed said voltage source is connected across said coil of said relay energizing said coil of said relay causing said relay to make contact between said normally open terminal and said common terminal causing said closed on/off switch, said diode, said capacitor and said connecting means to be serially connected across said voltage source; and when said on/off switch is subsequently opened, disconnecting said voltage source from said coil of said relay, or when said voltage source fails, said coil of said relay is deenergized and contact is made between said normally closed terminal and said common terminal, causing said connector means to be connected across said capacitor.

2. The control circuit set forth in claim 1 wherein the coil of a latching solenoid is connected across said connecting means, said latching solenoid comprising:

a solenoid coil and a plunger;

said plunger being set to one of two states comprising an extended state and a withdrawn state by a current pulse passing through the solenoid coil in an appropriate direction, the set state being sustained without the benefit of a holding current until a current pulse is applied in the opposite direction;

when said on/off switch of said control circuit is closed said coil of said latching solenoid is serially connected with said on/off switch, said diode, said normally open and common terminals of said relay, and said capacitor across said voltage source thereby initiating a first pulse of current passing through said coil of said latching solenoid in a first direction and leaving a charge on said capacitor; and when said on/off switch is subsequently opened, or when said voltage source fails, said capacitor is connected across the coil of said latching relay causing said charge of said capacitor to be discharged into said coil of said latching solenoid, said discharge occurring in the form of a second current pulse passing through said coil of said latching solenoid in the direction opposite that of said first current pulse;

said first current pulse causing said latching solenoid to be set to a first of its two states and said second current pulse which is opposite in direction from that of said first current pulse causing said latching solenoid to be set to the second of its two states, with successive current pulses initiated by successive closures and openings of said on/off switch producing current pulses alternating in direction through said coil of said latching solenoid and causing the state of said solenoid to alternate between said first and said second states.

3. The control circuit set forth in claim 2 incorporated in an electric door strike wherein:

said first pulse of current initiated by the closure of said on/off switch causes said latching solenoid to be set to a state which causes the door strike to assume a locked condition while said second pulse of current is initiated by the opening of said on/off switch or by the loss of said voltage source causing said latching solenoid to be set to a state which causes said door strike to assume an unlocked condition, such operation being characterized as a fail safe operation.

4. The control circuit set forth in claim 2 incorporated in an electric door strike wherein:

said first current pulse initiated by the closure of said on/off switch causes said latching solenoid to be set to a state which causes said door strike to assume an unlocked condition while said second current pulse initiated by the opening of said on/off switch or by the loss of said voltage source causes said latching solenoid to be set to a state which causes said door strike to assume a locked condition, such operation being characterized as fail secure operation.

5. The control circuit set forth in claim 2 incorporated in an electric door strike wherein:

said connecting means is reversible such that the polarity of the connected coil of said latching solenoid may be selected to achieve either fail safe or fail secure operation as appropriate for a given installation of said electric door strike.

6. The control circuit as set forth in claim 3 wherein:

said on/off switch comprises a normally closed momentary switch.

7. The control circuit as set forth in claim 4 wherein said on/off switch is a normally open momentary switch.

8. The control circuit as set forth in claim 3 wherein:

said on/off switch comprises a double-action on/off switch.

9. The control circuit as set forth in claim 4 wherein:

said on/off switch comprises a double-action on/off switch.

10. The control circuit as set forth in claim 2 in further combination with a three-terminal regulator which regulates the voltage supplied to the coil of said relay.

* * * * *